US008613852B2

(12) United States Patent
Leta et al.

(10) Patent No.: US 8,613,852 B2
(45) Date of Patent: Dec. 24, 2013

(54) PROCESS FOR PRODUCING A HIGH STABILITY DESULFURIZED HEAVY OILS STREAM

(75) Inventors: Daniel P. Leta, Flemington, NJ (US); Walter D. Vann, Glen Mills, PA (US); David T. Ferrughelli, Flemington, NJ (US); Eric B. Sirota, Flemington, NJ (US); Howard Freund, Neshanic Station, NJ (US)

(73) Assignee: ExxonMobil Research and Engineering Company, Annandale, NJ (US)

( * ) Notice: Subject to any disclaimer, the term of this patent is extended or adjusted under 35 U.S.C. 154(b) by 197 days.

(21) Appl. No.: 12/967,437

(22) Filed: Dec. 14, 2010

(65) Prior Publication Data

US 2011/0147271 A1 Jun. 23, 2011

Related U.S. Application Data

(60) Provisional application No. 61/284,529, filed on Dec. 18, 2009.

(51) Int. Cl.
*C10G 19/00* (2006.01)
*C10G 19/073* (2006.01)
*C10G 19/08* (2006.01)

(52) U.S. Cl.
USPC ..... 208/229; 208/40; 208/208 R; 208/226; 208/209

(58) Field of Classification Search
USPC ..... 208/209, 41, 44, 212, 40, 226, 208 R, 208/229
See application file for complete search history.

(56) References Cited

U.S. PATENT DOCUMENTS

| | | | |
|---|---|---|---|
| 2,360,272 | A | 10/1944 | Plummer |
| 3,051,645 | A | 8/1962 | Wilson et al. |
| 3,104,157 | A | 9/1963 | Kimberlin, Jr. et al. |
| 3,136,714 | A | 6/1964 | Gibson et al. |
| 3,164,545 | A | 1/1965 | Mattox |
| 3,354,081 | A | 11/1967 | Aldridge |
| 3,383,304 | A | 5/1968 | Mattox et al. |
| 3,387,941 | A | 6/1968 | Murphy et al. |
| 3,442,797 | A | 5/1969 | Aldridge |
| 3,449,242 | A | 6/1969 | Mattox et al. |
| 3,835,033 | A | 9/1974 | Dugan et al. |
| 3,847,797 | A | 11/1974 | Pasternak et al. |

(Continued)

FOREIGN PATENT DOCUMENTS

| | | |
|---|---|---|
| GB | 1133695 | 11/1968 |
| GB | 2067173 | 7/1981 |

OTHER PUBLICATIONS

Tesoro Corporation, Material Safety Data Sheet, Naphtha, pp. 1-14.*

(Continued)

*Primary Examiner* — Walter D Griffin
*Assistant Examiner* — Derek Mueller
(74) *Attorney, Agent, or Firm* — Bruce M. Bordelon

(57) ABSTRACT

Self-compatible heavy oil streams are produced from converted and/or desulfurized fractions. In a preferred embodiment, an incompatibility stream is added to the converted and/or desulfurized stream to reduce the solubility number of the stream. After using a water wash to remove incompatible material, a lighter fraction is removed from the stream to increase the solubility number.

23 Claims, 1 Drawing Sheet

(56) References Cited

U.S. PATENT DOCUMENTS

| | | | | |
|---|---|---|---|---|
| 3,850,742 | A | 11/1974 | Dugan et al. | |
| 3,852,188 | A | 12/1974 | Dugan et al. | |
| 3,873,670 | A | 3/1975 | Dugan et al. | |
| 3,876,527 | A | 4/1975 | Dugan et al. | |
| 4,003,823 | A | 1/1977 | Baird, Jr. et al. | |
| 4,003,824 | A | 1/1977 | Baird, Jr. et al. | |
| 4,007,109 | A | 2/1977 | Baird, Jr. et al. | |
| 4,007,110 | A | 2/1977 | Bearden, Jr. | |
| 4,007,111 | A | 2/1977 | Baird, Jr. | |
| 4,087,348 | A | 5/1978 | Baird, Jr. et al. | |
| 4,119,528 | A | 10/1978 | Baird, Jr. et al. | |
| 4,127,470 | A | 11/1978 | Baird, Jr. et al. | |
| 4,147,611 | A | 4/1979 | Miasek et al. | |
| 4,147,612 | A | 4/1979 | Miasek et al. | |
| 4,437,908 | A | 3/1984 | Inoue | |
| 4,545,891 | A | 10/1985 | Meyers et al. | |
| 4,566,965 | A | 1/1986 | Olmstead | |
| 4,808,298 | A | 2/1989 | Peck et al. | |
| 4,915,819 | A * | 4/1990 | Chirinos et al. | 208/309 |
| 4,927,524 | A | 5/1990 | Rodriguez et al. | |
| 5,059,307 | A | 10/1991 | Meyers et al. | |
| 5,085,764 | A | 2/1992 | Meyers et al. | |
| 5,508,018 | A | 4/1996 | Brons et al. | |
| 5,626,742 | A | 5/1997 | Brons et al. | |
| 5,635,056 | A | 6/1997 | Brons et al. | |
| 5,695,632 | A | 12/1997 | Brons et al. | |
| 5,871,637 | A | 2/1999 | Brons | |
| 5,904,839 | A | 5/1999 | Brons | |
| 5,935,421 | A | 8/1999 | Brons et al. | |
| 5,997,723 | A | 12/1999 | Wiehe et al. | |
| 2004/0069682 | A1 | 4/2004 | Freel et al. | |
| 2004/0069686 | A1 | 4/2004 | Freel et al. | |
| 2008/0047874 | A1 * | 2/2008 | Brons et al. | 208/177 |
| 2009/0152168 | A1 | 6/2009 | Siskin et al. | |

OTHER PUBLICATIONS

Tesoro Corporation, Material Safety Data Sheet, Naphtha MSDS, 2011, pp. 1-14.*

Parkash, S, Refining Processes Handbook, 2003, Gulf Publishing, pp. 176-209.*

Robert A. Meyers (Ed.), Handbook of Petroleum Refining Processes, 2003, McGraw-Hill, 3rd Edition, pp. 12.12-12.13.

Ana M. Benito, Maria T. Martinez, Isaias Fernandez and Jose L. Miranda, "Visbreaking of an Asphaltenic Coal Residue", Fuel, vol. 74, No. 6, 1995, pp. 922-927.

* cited by examiner

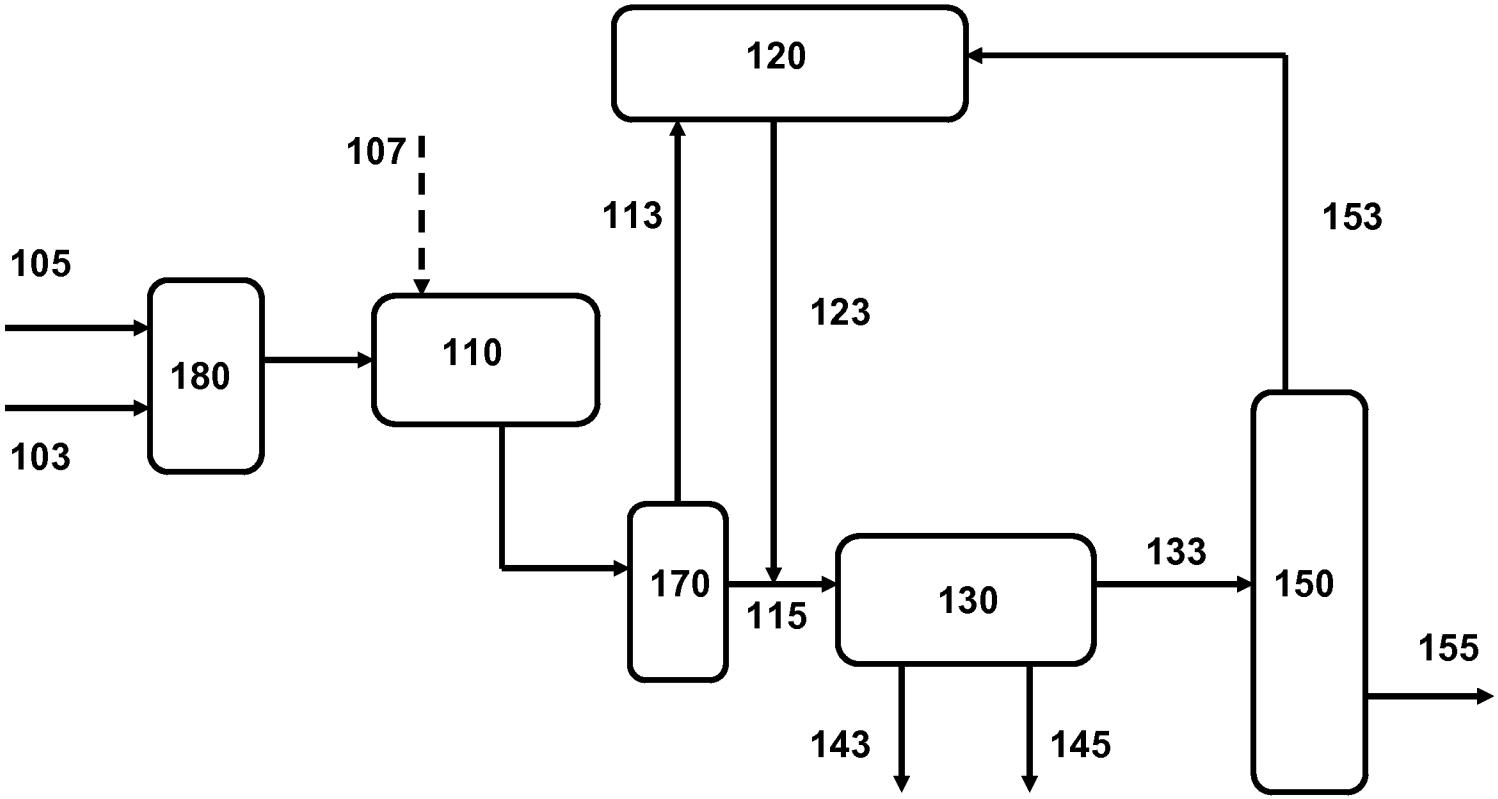
105
103
180
107
110
113
120
123
170
115
130
133
145
143
150
153
155

PROCESS FOR PRODUCING A HIGH STABILITY DESULFURIZED HEAVY OILS STREAM

This application claims the benefit of U.S. Provisional Application No. 61/284,529 filed Dec. 18, 2009.

FIELD OF THE INVENTION

The present invention relates to a process for conversion, such as desulfurization, of heavy oil feedstreams and improving the self-compatibility of the stream.

DESCRIPTION OF RELATED ART

Heavy oils and bitumens make up an increasing percentage of available liquid hydrocarbon resources. As the demand for hydrocarbon-based fuels has increased, the need for improved processes for desulfurizing heavy oil feedstreams has increased as well as the need for increasing the conversion of the heavy portions of these feedstreams into more valuable, lighter fuel products. These heavy oil feedstreams include, but are not limited to, whole and reduced petroleum crudes, shale oils, coal liquids, atmospheric and vacuum residua, asphaltenes, deasphalted oils, cycle oils, FCC tower bottoms, gas oils, including atmospheric and vacuum gas oils and cooker gas oils, light to heavy distillates including raw virgin distillates, hydrocrackates, hydrotreated oils, dewaxed oils, slack waxes, raffinates, and mixtures thereof. Hydrocarbon streams boiling above 430° F. (220° C.) often contain a considerable amount of large multi-ring hydrocarbon molecules and/or a conglomerated association of large molecules containing a large portion of the sulfur, nitrogen and metals present in the hydrocarbon stream. A significant portion of the sulfur contained in these heavy oils is in the form of heteroatoms in polycyclic aromatic molecules, comprised of sulfur compounds such as dibenzothiophenes, from which the sulfur is difficult to remove.

Many refineries lack the conversion equipment necessary to process these heavier crude oils. In order to increase crude oil value, as well as to enable pipeline or other crude oil transportation, it is often desirable to "pre-convert" a bitumen to some extent at or near the well or production facility. Partial conversion techniques are often severely hampered in their ability to perform significant conversion due to compatibility problems with the partially converted product. For example, one problem that exists in the industry is that heavy oil streams can be difficult to process due to the tendency of asphaltene components to precipitate during processing. This can lead to fouling of the process equipment and/or catalyst, or alternatively can require expensive and complicated facilities to handle and process a feed with increased solids content.

A further problem exists in that many heavy oils, such as crudes, synthetic crudes, rough crude distillation cuts, and bitumens often need to be transported over pipelines spanning hundreds of miles for further processing at refineries and other related upgrading facilities. These pipelines typically have strict regulations on the solids content of the streams. To meet these regulations, a stream delivered to a pipeline should be low in solids. The stream should also be stable so that the incompatible hydrocarbon compounds such as asphaltenes do not precipitate out of the stream during pipeline shipments and/or in the storage facilities associated with the pipeline transport.

SUMMARY OF THE INVENTION

Described herein are processes for producing a self-compatible conversion product stream.

An embodiment of the invention herein is a process for producing a stable self-compatible hydrocarbon product stream, comprising:

performing a conversion process on a heavy oils feedstream with an API gravity of less than about 19 to produce a conversion product stream comprised of a conversion product stream having an API gravity of at least about 20;

adding an incompatibility stream having a T95 boiling point less than about 450° F. (232° C.) to the conversion product stream to form a mixed conversion stream;

washing the mixed conversion stream with water to remove precipitated solids from the mixed conversion stream thereby forming a washed product stream;

separating the washed product stream into a self-compatible product stream and a light ends fraction; and storing at least a portion of the light ends fraction in a vessel;

wherein the incompatibility stream is comprised of at least a portion of the light ends fraction.

In a preferred embodiment, the portion of the light ends fraction used in the incompatibility stream has a T5 boiling point of at least 80° F. and a T95 boiling point of less than 450° F. In a more preferred embodiment, the amount of the incompatibility stream added to the conversion product stream is sufficient to lower the solubility number ($S_{BN}$) of the combined incompatibility stream and conversion product stream by at least 10. In yet an even more preferred embodiment, the solubility number ($S_{BN}$) of the self-compatible product stream is at least about 20 greater than the solubility number ($S_{BN}$) of the conversion product stream.

In yet another more preferred embodiment, the conversion process comprises a desulfurization process using an alkali metal salt reagent.

Another embodiment of the invention herein is process for producing a stable self-compatible hydrocarbon product stream, comprising:

performing a conversion process on a heavy oils feedstream with an API gravity of less than about 19 to produce at least a liquid conversion product stream with an API gravity of at least about 20;

washing the liquid conversion product stream with water to remove at least a portion of the precipitated solids from the liquid conversion product stream to form a washed liquid conversion product stream; and fractionating the washed liquid conversion product stream to form a self-compatible product stream and a light ends fraction, the light ends fraction comprising at least a lowest boiling 1% of a volume of the washed liquid conversion product stream, wherein the self-compatible product stream has a solubility blending number ($S_{BN}$) that is at least about 10 greater than the incompatibility number ($I_N$) of the self-compatible product stream.

In a preferred embodiment, the conversion process further comprises introducing hydrogen into the conversion process. In another preferred embodiment, the conversion process comprises a desulfurization process using an alkali metal salt reagent. In a more preferred embodiment, the reaction conditions of the conversion process comprise a pressure of from about 50 to about 3000 psi (345 to 20,684 kPa), and a temperature from about 600° F. to about 900° F. (316° C. to 482° C.).

BRIEF DESCRIPTION OF THE FIGURES

The FIGURE herein schematically shows an apparatus according to an embodiment of the invention.

DETAILED DESCRIPTION OF THE INVENTION

Overview

In various embodiments, methods are provided for producing self-compatible heavy oil product streams from a conversion process. A crude oil or other heavy oil stream that contains asphaltenes is susceptible to having the asphaltenes precipitate under certain conditions. In particular, if the solubility number of the heavy oil fraction is sufficiently close to the insolubility number, the heavy oil can be susceptible to asphaltene precipitation based on relatively minor changes in temperature and/or pressure.

A conversion process, such as a desulfurization process, can reduce the difference between the solubility and insolubility numbers for a heavy oil. As the name suggests, a conversion process converts heavier molecules into lighter molecules. As utilized herein, the term "conversion" or "conversion process" is defined as a process for treating a feedstream containing liquid hydrocarbons that results in a liquid hydrocarbon product that has a higher API gravity than the feedstream to the process. As utilized herein, the term "desulfurization" or "desulfurization process" is defined as a process for treating a feedstream containing liquid sulfur-containing hydrocarbons that results in a liquid hydrocarbon product that has a lower sulfur content than the feedstream to the process. For heavy oils, most desulfurization processes also result in some amount of conversion (lower API gravity). As such, unless otherwise noted herein, the term "conversion process" includes the subset of "desulfurization processes."

A significant problem that exists in the art is that conversion processes can leave the insolubility number relatively unchanged due to lack of conversion of some asphaltenes within the product stream. In some instances, the insolubility number can even increase due to molecular weight growth of asphaltenic species during the conversion process. As a result, a heavy oil product stream from a conversion process can be susceptible to unintentional asphaltene precipitation. In various embodiments, the invention modifies the solubility and insolubility characteristics of a heavy oil to decrease or mitigate the likelihood of such asphaltene precipitation. In such embodiments, asphaltenes can be precipitated out of the product stream in a controlled manner so that undesirable fouling of other process equipment does not occur.

One option herein for improving the compatibility of a hydrocarbon stream after a conversion process is to perform a water wash of the converted stream. The water wash can be used to remove solids that formed during the conversion process. In an embodiment of the present invention, after removing the solids, the conversion product can then be fractionated to remove a low boiling point fraction of the conversion product. Removing a sufficient weight percentage of the low boiling point portion of the conversion product can raise the solubility number of the conversion product. In combination with removing solids by a water wash, this can lead to formation of a self-compatible stream.

In another embodiment, prior to a water wash, at least a portion of the low boiling point fraction generated during the conversion process can be added to the conversion product. Addition of this low boiling point fraction can increase the formation of solids in the converted feed. The low boiling point fraction added back into the converted feed can be referred to as an incompatibility stream. The water wash can then remove these additional solids. The amount of the low boiling point fraction removed during fractionation can then be increased to remove the added low boiling point fraction that has been added to the conversion product.

In still another embodiment, after performing a conversion on a heavy oil feed, the conversion product stream can be combined with an incompatibility stream. The incompatibility stream can be a stream that includes low boiling point compounds, such as naphthas and light distillates. The incompatibility stream can include a low boiling point fraction generated during the conversion process. In some embodiments, the amount of incompatibility stream added to the conversion product stream can be greater in volume than the volume of low boiling point fraction generated during the conversion process. In a preferred embodiment, the amount of the incompatibility stream (by mass flow rate) added to the conversion product stream is at least about twice the amount of the light ends fraction (by mass flow rate) separated from the washed product stream in the fraction step described herein. In such embodiments, at least a portion of the incompatibility stream can represent a stream provided from another refinery source or process. Alternatively, at least a portion of the incompatibility stream can be provided from a stored stream of low boiling compounds generated from the conversion process and low boiling point fractions separated during the final fractionation step to produce the self-compatible stream. The incompatibility stream can reduce the solubility number of the combined stream, leading to precipitation of asphaltenes from the stream. The combined stream can then washed to remove the precipitated solids thereby reducing the insolubility number. The washed combined stream can then be fractionated to separate out the low boiling point fraction from a final product stream. After removal of both the precipitated asphaltenes and the light ends, the resulting final product stream can be a self-compatible stream with an insolubility number that is sufficiently lower than the solubility number to reduce the likelihood of unintentional asphaltene precipitation.

In some embodiments, the methods of the invention can be used to produce a self-compatible stream that is suitable for transport in a pipeline. In such an embodiment, a converted and/or desulfurized heavy oil stream can be produced that has an API of at least about 19. In other embodiments, the invention can be used to convert a heavy oil stream having an API of about 19 or less into a stream having an API of about 20 or greater. Optionally, a low boiling point fraction can be removed from the converted stream having an API of 20 or greater to form a fraction with a lower API and a light ends fraction.

Feedstocks

Various embodiments of the invention can be useful for improving the self-compatibility of an oil fraction or stream that contains asphaltenes.

Asphaltenes are typically present in "heavy oil feedstreams" or "heavy oil streams", which as used herein are equivalent and are defined as any hydrocarbon-containing streams having an API gravity equal to or less than 19. Preferred heavy oil feedstreams for use in the present invention include, but are not limited to low API gravity, high sulfur, high viscosity crudes; tar sands bitumen; liquid hydrocarbon streams derived from tar sands bitumen, coal, or oil shale; as well as petrochemical refinery heavy intermediate fractions, such as atmospheric resids, vacuum resids, and other similar intermediate feedstreams and mixtures thereof containing boiling point materials above about 650° F. (343° C.). Heavy oil feedstreams as described herein may also include a blend of the hydrocarbons listed above with lighter hydrocarbon streams, such as, but not limited to, distillates, kerosene, or light naphtha diluents, and/or synthetic crudes, for control of certain properties desired for the transport or sale of the resulting hydrocarbon blend, such as, but not limited to, transport or sale as fuel oils and crude blends. In preferred embodiments of the present invention, the heavy oil feedstream contains at least 60 wt % hydrocarbon compounds, and more preferably, the heavy oil feedstream contains at least 75 wt % hydrocarbon compounds.

In some embodiments, the conversion process can be a desulfurization process for removing sulfur from the heavy oil feedstream. In such embodiments, the heavy oil feedstream can contain at least about 0.5 wt % sulfur, preferably at least about 1 wt % sulfur, and more preferably at least about 3 wt % sulfur. In other embodiments, the heavy oil feedstream can contain polycyclic sulfur heteroatom complexes which are difficult to desulfurize by conventional methods.

Asphaltenes generally refer to a polar fraction of higher molecular weight aromatic and polycyclic heteroatom-containing compounds within a feedstream. At least a portion of the sulfur content of a heavy oil feedstream can be part of the asphaltene content of the feedstream. Other sulfur compounds can be associated with asphaltenes in an emulsion phase of such asphaltene species. "Asphaltenes" or the "asphaltene content" of a hydrocarbon stream as used herein are measured by ASTM D 6560-00 "Standard Test Method for Determination of Asphaltenes (Heptane Insolubles) in Crude Petroleum and Petroleum Products".

Solubility Blending Number and Insolubility Number

Another way to characterize the properties of a heavy oil stream is by determining the solubility blending number ($S_{BN}$) and insolubility number ($I_N$) for the stream. When the insolubility number for a stream is about equal to or greater than the solubility blending number, precipitation of asphaltenes is likely to occur.

The solubility blending number and insolubility number are described in greater detail in U.S. Pat. No. 5,871,634. The solubility blending number and insolubility number for a petroleum fraction or oil containing asphaltenes can be calculated by testing the solubility of the petroleum fraction in test liquid mixtures at the minimum of two volume ratios of oil to test liquid mixture. The test liquid mixtures are prepared by mixing two liquids in various proportions. Preferably, the two liquids for the test liquid mixtures are n-heptane and toluene.

A convenient volume ratio of oil to test liquid mixture can be selected for the first test, such as 1 ml of oil to 5 ml of test liquid mixture. Test liquid mixtures having varying volume concentrations of n-heptane and toluene can then be prepared. Each of these can be mixed with the oil at the selected volume ratio of oil to test liquid mixture to determine if the asphaltenes are soluble or insoluble in each test liquid mixture. Any convenient method can be used. One possibility is to observe a drop of the blend of test liquid mixture and oil between a glass slide and a glass cover slip using transmitted light with an optical microscope at a magnification of from 50 to 600×. If the asphaltenes are in solution, few, if any, dark particles will be observed. If the asphaltenes are insoluble, many dark, usually brownish particles, typically 0.5 to 10 microns in size, will be observed. Another possible method is to put a drop of the blend of test liquid mixture and oil on a piece of filter paper and let dry. If the asphaltenes are insoluble, a dark ring or circle will be seen about the center of the yellow-brown spot made by the oil. If the asphaltenes are soluble, the color of the spot made by the oil will be relatively uniform in color.

The results of blending oil with all of the test liquid mixtures can be ordered according to increasing percent toluene in the test liquid mixture. The desired value is then taken to be the mean of the minimum percent toluene that dissolves asphaltenes and the maximum percent toluene that precipitates asphaltenes. This is the first datum point, $T_1$, at the selected oil to test liquid mixture volume ratio, $R_1$. This test is called the toluene equivalence test. Note that if increased accuracy is desired, additional test liquid mixtures can be prepared that have a toluene percentage between the minimum percentage that dissolves asphaltenes and the maximum percentage that precipitates asphaltenes. These additional test liquid mixtures can be blended with oil at the selected oil to test liquid mixture volume ratio to again determine if the asphaltenes are soluble or insoluble. This process is continued until the desired value is determined within the desired accuracy. Preferably, the process can be continued until the difference in toluene percentage between the minimum percentage that dissolves asphaltenes and the maximum percentage the precipitates asphaltenes is about 5% or less.

The second datum point can be determined by the same process as the first datum point, only by selecting a different oil to test liquid mixture volume ratio. Alternatively, a percent toluene below that determined for the first datum point can be selected and that test liquid mixture can be added to a known volume of oil until asphaltenes just begin to precipitate. At that point the volume ratio of oil to test liquid mixture, $R_2$, at the selected percent toluene in the test liquid mixture, $T_2$, becomes the second datum point. Since the accuracy of the final numbers increase with increasing distance between the second datum point and the first datum point, the preferred test liquid mixture for determining the second datum point is 100% n-heptane. This test is called the heptane dilution test.

Based on $R_1$, $R_2$, $T_1$, and $T_2$, $I_N$ and $S_{BN}$ can be calculated using the following equations.

$$I_N = T_2 - \left[\frac{T_2 - T_1}{R_2 - R_1}\right]R_2$$

$$S_{BN} = I_N\left[1 + \frac{1}{R_2}\right] - \frac{T_2}{R_2}$$

During a conversion process, including but not limited to a desulfurization process, the insolubility number will typically be increased. If the conversion process results in the formation of precipitates, the increase will typically result in the insolubility number being about equal to the solubility blending number.

In an embodiment, a heavy oil stream produced by a conversion and/or desulfurization process can have an insolubility number of at least about 65, or at least about 75, or at least about 80. The solubility blending number for a heavy oil stream produced by a conversion and/or desulfurization process can be at least about 65, or at least about 70, or at least about 75, or at least about 80, or at least about 85.

Conversion and/or Desulfurization Methods

In various embodiments, the heavy oil feedstream is subjected to a conversion process. In a preferred embodiment, the conversion process is a desulfurization process as a typical heavy oil desulfurization process will also result in at least some conversion of the feed. Typical processes for conversion and/or desulfurization of a feed can include thermal cracking processes, such as visbreaking or coking. Catalytic processes can also be used, such as exposing a feed to catalyst such as a supported nickel catalyst under elevated temperature and pressure conditions. A source of hydrogen is often introduced to such processes to enable and/or enhance desulfurization. It is noted that some processes can involve consumption of a metal for sulfur removal, as opposed to having the metal play a strictly catalytic role. More generally, in various embodiments of the invention, processes that lead to desulfurization and/or conversion of a feed can be used for the conversion step.

In an embodiment, the conversion process can be a process for desulfurizing heavy oil feedstreams with alkali metal salt reagent compounds. Preferably, the alkali metal reagents are selected from alkali metal hydroxides and alkali metal sulfides. The alkali metal hydroxides are preferably selected from potassium hydroxide, sodium hydroxide, rubidium hydroxide, cesium hydroxide, and mixtures thereof. The alkali metal sulfides are preferably selected from potassium sulfide, sodium sulfide, rubidium sulfide, cesium sulfide, and mixtures thereof. These alkali metal reagents are particularly useful in the desulfurization and demetallization of a heavy oil feedstream wherein a significant portion of asphaltenes may be present in the heavy oil stream. In an embodiment, the alkali metal salt reagents can be provided in the form of an aqueous alkali metal salt reagent stream. If an aqueous alkali metal salt reagent stream is used, the mixture of heavy oil and aqueous alkali metal can be at least partially dehydrated prior to convert the aqueous alkali metal salt reagent to solid particles.

The alkali metal salt reagent stream can be contacted with a heavy oil feedstream in a suitable reactor. Herein, the conversion or desulfurization reactor can be comprised of a vessel or even simply piping which provides sufficient contact time and conditions for a desired level of desulfurization of the hydrocarbon portion of the overall process stream. A hydrogen-containing stream may optionally be added to an alkali metal desulfurization reaction. If a hydrogen-containing stream is utilized, it is preferred that the hydrogen-containing stream contain at least 50 mol % hydrogen, more preferably at least 75 mol % hydrogen. When hydrogen is utilized in the process, it is preferred that the hydrogen partial pressure in the heavy oils desulfurization reactor be from about 100 to about 2500 psi (689 to 17,237 kPa). At these partial pressures, the hydrogen assists in the reaction process by removing at least a portion of the sulfur in the hydrocarbons via conversion to the alkali metal hydrosulfide, which may, but is not required to, go through a hydrogen sulfide, $H_2S$ intermediate. Hydrogen sulfide that is formed in the first reaction zone can also react with the alkali metal hydroxides donating some of the sulfur and forming alkali metal hydrosulfides and alkali metal sulfides thereby improving the overall sulfur removal in the process. Excess hydrogen also assists in hydrogenating the broken sulfur bonds in the hydrocarbons and increasing the hydrogen saturation of the resulting desulfurized hydrocarbon compounds.

Suitable conversion or desulfurization conditions in the heavy oils reactor can include temperatures from about 600° F. to about 900° F. (316° C. to 482° C.), preferably about 650° F. to about 875° F. (343° C. to 468° C.), and more preferably about 700° F. to about 850° F. (371° C. to 454° C.). Suitable reaction pressures can be from about 50 to about 3000 psi (345 to 20,684 kPa), preferably about 200 to about 2200 psi (1,379 to 15,168 kPa), and more preferably about 500 to about 1500 psi (3,447 to 10,342 kPa). In a preferred embodiment, the contact time of the heavy oils feedstream and the alkali metal hydroxide stream in the heavy oils reactor can be about 5 to about 720 minutes, preferably about 30 to about 480 minutes, and more preferably 60 to about 240 minutes. It is noted that a suitable contact time can be dependent upon the physical and chemical characteristics of the hydrocarbon stream including the conversion to be achieved, the sulfur content and sulfur species of the hydrocarbon feedstream, the amount of sulfur to be removed from the hydrocarbon feedstream, and the molar ratio of the alkali metal reagent used in the process to the sulfur present in the heavy oils feedstream.

In preferred embodiments, the type and/or configuration of the conversion or desulfurization reactor can be selected to facilitate proper mixing and contact between the heavy oil feedstream and the alkali metal reagent stream. Examples of preferred reactor types include slurry reactor or ebullating bed reactor designs. Additionally, static, rotary, or other types of mixing devices can be employed in the feed lines to heavy oils desulfurization reactor, and/or mixing devices can be employed in the heavy oils reactor to improve the contact between the heavy oil feedstream and the alkali metal reagent stream. Still other devices that can be employed include heaters and/or drying drums. Such devices can be included after mixing of the heavy oil feedstream and the alkali metal salt reagent stream, but prior to the reactor. Such devices can be used to remove water from the combined feedstream and alkali metal salt reagent to facilitate formation of alkali metal salt particles, which serve as a reagent during conversion/desulfurization.

In embodiments involving a desulfurization process, the sulfur content by wt % of the final product stream can be less than about 40% of the sulfur content by wt % of the heavy oils feedstream. In a more preferred embodiment of the present invention, the sulfur content by wt % of the final product stream is less than about 25% of the sulfur content by wt % of the heavy oils feedstream. In a most preferred embodiment of the present invention, the sulfur content by wt % of the final product stream is less than about 10% of the sulfur content by wt % of the heavy oils feedstream. These parameters are based on water-free hydrocarbon streams.

In another embodiment, visbreaking can be used as a conversion process. In a visbreaking process, a feed can be heat soaked for a period of time at a temperature from about 427° C. to about 468° and at a pressure of from about 500 kPag to about 1000 kPag. A visbreaking process can reduce the viscosity of a heavy oil feedstream by cracking (converting) feed components to make distillate or lighter boiling range compounds.

After desulfurization and/or conversion, the resulting conversion product stream can preferably be sent to a low pressure separator wherein at least a portion of the of the hydrogen, light hydrocarbons, and non-condensable components of the desulfurized (or converted) product stream can be removed. In an embodiment involving an alkali metal reagent process for desulfurization, this produces a degassed reaction stream containing desulfurized hydrocarbons and spent alkali metal compounds.

Incompatibility Stream

One method for improving the compatibility of a converted and/or desulfurized heavy oil feedstream (i.e., a "conversion product stream") is to use a water wash to remove asphaltenes. After removal of asphaltenes, fractionation can be used to remove low boiling point fraction of the converted and/or desulfurized stream to produce a compatible stream. This type of method can be enhanced by adding an incompatibility stream to the converted and/or desulfurized heavy oil stream prior to the water wash. At least a portion of this low boiling point fraction removed from the conversion product stream can be used as the incompatibility stream herein.

The low boiling point fraction herein is characterized by its "end points" which are the temperatures at which 5% of the stream will boil (T5 boiling point) and at which 95% of the stream will boil (T95 boiling point). In a preferred embodiment, the low boiling point fraction has a T5 boiling point of at least 80° F. and a T95 boiling point of less than 450° F. More preferably, the low boiling point fraction has a T5 boiling point of at least 150° F. and a T95 boiling point of less than 400° F.; and even more preferably, the low boiling point fraction has a T5 boiling point of at least 200° F. and a T95 boiling point of less than 350° F. In a preferred embodiment of the present invention, at least a portion of the low boiling point fraction removed from the conversion product stream is used as the incompatibility stream herein.

In various embodiments, an incompatibility stream can be added to a converted and/or desulfurized heavy oil stream to induce precipitation of asphaltenes. An incompatibility stream can be added before or after the optional low pressure separation. The incompatibility stream can be any stream that reduces the solubility blending number of a heavy oil. Preferably, the incompatibility stream can include naphtha and/or light distillate fractions, such as naphtha or light distillate fractions during the conversion or desulfurization process.

Adding an incompatibility stream to a converted (or desulfurized) heavy oil stream will typically result in a mixed stream that has a lower solubility blending number than the heavy oil stream. This is due in part to the reduced amount of aromatic type compounds typically present in lower boiling point fractions. However, the incompatibility stream will typically have little or no impact on the insolubility number for a heavy oil stream, as adding an incompatibility stream will not change the nature of asphaltenes present in the heavy oil stream. As a result, the addition of the incompatibility stream will reduce the difference between the solubility blending number and the insolubility number.

In an embodiment, the amount of incompatibility stream added to the converted heavy oil stream can be sufficient to reduce the solubility blending number by at least about 2, or at least about 5, or at least about 10, or at least about 15, or at least about 20. In some embodiments, the resulting mixed stream can have a solubility blending number that is about equal to or less than the insolubility number. Note that if mixing an incompatibility stream with a converted heavy oil stream (conversion product stream) results in a solubility blending number is less than the insolubility number, subsequent precipitation of asphaltenes is likely to occur in an amount sufficient to cause the solubility blending number and the insolubility number to become roughly equal.

The conversion product stream and the incompatibility stream are mixed together to form a "mixed product stream" and the mixture is maintained for an amount of time to allow precipitation of asphaltenes. In an embodiment, the amount of time the streams remain together can be determined by the flow rate of the streams in the process equipment. For example, a water wash step can be used to remove asphaltenes from the mixed product stream. The amount of time for precipitation can be determined by the time needed for the mixed product stream to travel from the initial mixing point to the water wash zone. Alternatively, a holding vessel can be used to provide an increased amount of time between forming the mixed product stream and treating the mixed product stream to remove precipitated asphaltenes. In an embodiment, the amount of time between forming the mixed product stream and the method for removing precipitated asphaltenes can be at least about 10 seconds, or at least about 1 minute, or at least about 10 minutes. Alternatively, the amount of time can be about 30 minutes or less, or about 5 minutes or less, or about 1 minute or less.

In still another alternative embodiment, the addition of an incompatibility stream can be optional. In such an alternative embodiment, an incompatibility stream is not added to the conversion product stream. Instead, a self-compatible feed is formed by the removal of light ends as described below.

Forming a Self-Compatible Stream

In an embodiment, after a desired amount of time for precipitation of asphaltenes has passed, the mixed product stream, the hydrocarbon portions and aqueous portions of the stream can be separated. This is preferably accomplished by sending the mixed product to a hydrocarbon product separator wherein the spent alkali metal compounds are separated from the hydrocarbon-based portions of the stream by various methods known in the art. Preferably hydrocarbon product separation is accomplished at least in part by water washing. Here, the spent alkali metal compounds tend to be more soluble in the water-based phase than the hydrocarbon portions of the stream. As such, preferred methods of separation can further include gravitational (or density based) separations processes known in the art such as, but not limited to, the use of settling vessels, hydroclones, or centrifuges. In these processes, it is generally advantageous to keep the temperatures in the range of from 50° F. to about 300° F. (10° C. to 149° C.) in order to improve the contacting of the hydrocarbon with the water phase. In an embodiment, the output from the hydrocarbon product separator can be a converted and/or desulfurized hydrocarbon product stream and an aqueous spent alkali metal product stream.

During the water wash (or other separation process), the precipitated asphaltenes will typically be separated into the aqueous spent alkali metal product stream. Thus, the water wash can remove both the spent alkali metal and the asphaltenes from the conversion product stream. The precipitated asphaltenes can also be removed as solids that have settled into the aqueous phase during a settling process as described above. These solids can also be removed from the bottom of the hydrocarbon product separator.

In another embodiment, filtering can also be utilized to remove some of the solids compounds formed, such as, but not limited to, coke and precipitated asphaltenes, as well as iron, vanadium, and nickel compounds derived from the heavy oils feedstream.

After removal of the aqueous spent alkali metal product stream and precipitated asphaltenes, the washed conversion stream can be sent to a fractionator for removal of at least a portion of the "light ends" in the stream. In an embodiment, the fractionator can be used to remove a lightest fraction from the product stream, such as at least the lowest boiling 1% of the stream by volume, or at least the lowest boiling 2% by volume, or at least the lowest boiling 3% by volume, or at least the lowest boiling 4% by volume. Alternatively, the fractionator can remove the lowest boiling 6% or less by volume, or the lowest boiling 5% or less by volume, or the lowest boiling 4% or less by volume. In a preferred embodiment at least a portion of the light ends that are fractionated contains a low boiling point fraction as described herein.

In another embodiment, the amount of light ends that are removed can be based on boiling point. In such an embodiment, the portion removed by the fractionator can be a portion that boils at about 450° F. (232° C.) or less, or about 400° F. (204° C.) or less, or about 350° F. (177° C.) or less. In still another embodiment, the amount of light ends removed can be selected based on a desired increase in the solubility blending number for the product stream. In such an embodiment, the amount of light ends removed by the fractionator can be sufficient to produce an increase in the solubility blending number of at least about 2, or at least about 5, or at least about 8, or at least about 10, or at least about 15, or at least about 20. Alternatively, the amount of light ends removed can be sufficient to increase the solubility blending number by about 35 or less, or about 30 or less, or about 25 or less, or about 20 or less, or about 15 or less. In preferred embodiments, when addition of an incompatibility stream to a heavy oil stream results in formation of precipitates, the subsequent removal of light ends can be sufficient to increase the solubility blending number by at least about 15, or at least about 20, or at least about 25.

Note that in some embodiments, the amount of light ends to be removed can be characterized relative to the amount of the incompatibility stream that was added. For example, in an embodiment where a sufficient amount of the incompatibility stream was added to decrease the solubility blending number of the converted heavy oil stream by 20, then the fractionator can remove sufficient light ends to increase the solubility blending number by from about 15 to about 25. This corresponds to the fractionation causing an increase in the solubility blending number within about 25% of the decrease caused by the incompatibility stream. More generally, in such an embodiment the increase in solubility number from fractionation can be within about 35% of the amount of decrease in the solubility number due to addition of the incompatibility stream, or within about 25%, or within about 15%.

The FIGURE herein schematically shows an example of a reaction system for performing an embodiment of the invention. The FIGURE illustrates a preferred embodiment of the present invention wherein an alkali metal hydroxide treatment single reactor system is utilized. It should be noted that the FIGURE as presented herein is a simplified flow diagram, only illustrating the major processing equipment components and major process streams. It should be clear to one of skill in the art that additional equipment components and auxiliary streams may be utilized in the actual implementation of the invention as described.

In the embodiment shown in the FIGURE, a heavy oils feedstream 105 is mixed with an alkali metal stream 103 in a pre-mixing zone 180. In the pre-mixing zone 180, initial mixing and heating of the heavy oil feedstream and alkali metal salt reagent stream can occur. This is done to remove water from the mixed stream, leading to formation of KOH particles within the mixed stream. The dehydrated oil feedstream from the pre-mixing zone 180 can be combined with an optional hydrogen stream 107 in conversion reactor 110. Alternatively, the streams may be mixed prior to entering the reactor. The products from the conversion reactor 110 are sent to a separator 170 which produces an overhead stream 113 containing hydrogen, hydrogen sulfide, and/or other non-condensable products and a conversion product stream 115. Optionally, all or a portion of the overhead stream 113 can be sent to light ends vessel 120 for storage, or all or part of the stream can be sent for separate product processing, recycle, and/or waste gas disposal. Here, an incompatibility stream 123 from light ends vessel 120 is added to the conversion product stream 115. The mixed conversion product stream and incompatibility stream is contacted with water and is passed to a water wash vessel 130. The water wash vessel provides adequate residence time to produce an aqueous stream 143 and a washed product stream 133. The aqueous stream is comprised of spent alkali metal salts, which can be sent to a process for regenerating the alkali metal salts. This aqueous stream may also be further comprised of solids such as asphaltenes, coke, and other metals. Alternatively, a separate precipitate stream 145 containing a significant percentage of the trimmed asphaltenes, coke, and other metals that have been removed may also be withdrawn from the bottom of the water wash vessel 130. The washed product stream 133 is sent to a fractionator 150. The fractionator produces a light ends fraction 153 and a self-compatible final product stream 155. All or a portions of the light ends fraction 153 can be sent to light ends vessel 120 for storage and recycle as the incompatibility stream 123. Preferably, the light ends fraction 153 is predominantly with the properties of the low boiling point fraction described herein which possesses properties preferable for use as an incompatibility stream 123.

Example 1

Light Ends Fractionation

By way of example, molecular property modeling was carried out on a theoretical composition of a paraffin froth treated feed which had been converted via an alkali metal desulfurization process to an API of 21.7. In this example, the desulfurization results in about 70% 1050F+ conversion. The total liquid product stream was then theoretically distilled to varying percentages to demonstrate the effect of distillation on the API and the $S_{BN}$ of the final system. The results of the calculation are shown in Table 1 below:

TABLE 1

Removal via topping of light ends effects on API and $S_{BN}$

| % Removed | API | $S_{BN}$ | Δ API | Δ $S_{BN}$ |
|---|---|---|---|---|
| 0% | 21.7 | 89.4 | | |
| 1% | 20.9 | 91.1 | −0.8 | +1.7 |
| 2% | 20.2 | 92.6 | −1.5 | +3.2 |
| 3% | 19.5 | 94.1 | −2.2 | +4.7 |
| 4% | 19.0 | 95.4 | −2.7 | +6.0 |

It may be seen that the removal of only 4% of the lightest liquids results in an API decrease of 2.7 to 19, the pipeline specification, and an $S_{BN}$ increase of 6 units. If a larger than 6 unit $S_{BN}$ increase were desired, it would be desirable to convert the product to an even higher total liquid product API and then remove a greater portion of the liquids as light ends. In this manner a self-compatible heavy oil may be created which minimally meets pipeline specifications as well as generating a separated higher value light-ends stream similar to a condensate. Optionally the now separated light ends stream may be used to dilute additional unconverted bitumen to the desired API thus increasing the total pipelinable heavy oil obtained from the process.

Example 2

Example of Trim Deasphalting

To determine the degree of product losses a trim deasphalting/compatibilization scheme might involve, a series of conversion products generated using KOH as an alkali metal reagent catalyst were deasphalted using heptane and using a 1:1 mix of heptane and toluene. The deasphalting was done using a 10:1 ratio of solvents to oil. The heptane deasphalting is expected to result in a final product that has an $I_N$ value (insolubility number) of approximately 0, while the 1:1 heptane:toluene deasphalting is expected to result in a product having an $I_N$ of approximately 50. At the $I_N$=50 level, a heavy oil product would be not only self compatible, but also generally compatible with most other crude oils (those with $S_{BN}$ values >70).

Table 2 shows the results from the trim deasphalting runs. All of the conversion products were first diluted in toluene and filtered to remove the toluene insolubles (shown in the table as % TI). All of the conversion products showed at least some toluene insolubles. Thus, the conversion reaction in all cases was severe enough to drive the system to "near-incompatible" even after the removal of the solids. The % asphaltenes represents the weight percentage of carbon that precipitates out of the conversion products upon adding either the heptane or 50-50 mix of heptane and toluene, as described above. Also shown in the table is the micro-carbon residue (MCR) in the desulfurized feed.

TABLE 2

| Sample | Equivalent seconds at 875° F. | % 1050+ Conversion | % Desulf | MCR | % TI | % Asphaltenes heptane/ toluene (50:50) |
|---|---|---|---|---|---|---|
| Feed | 0 | 0 | 0 | 11.5 | 0 | 6.65/0 |
| 1 | 660 | 71 | 73 | 5.3 | 0.7 | 0.99/0.2 |
| 2 | 660 | 65 | 73 | 5.6 | 0.5 | 1.81/0.57 |
| 3 | 660 | 68 | 70 | 5.2 | 0.8 | 1.62/0.19 |
| 4 | 440 | 60 | 69 | 5.3 | 0.3 | 3.05/0.19 |
| 5 | 600 | 69 | 75 | 5.0 | 0.6 | 0.2/0.19 |

The percentage of the product which would be removed by a similar severity trim deasphalting step, but one performed using the process generated naphtha and distillate, in all cases was substantially less than 1%. Thus the final product quality would be substantially improved with minimal product volume loss.

Additional Embodiments

In a first embodiment, a process for producing a stable hydrocarbon product stream is provided. The process includes performing a conversion process on a heavy oils feedstream with an API gravity of less than about 18 to produce a conversion product stream having an API gravity of at least about 19 and a condensable low boiling portion. The condensable low boiling portion can have a first volume, and can also have a final boiling point of about 450° F. (232° C.) or less. An incompatibility stream having a boiling point less than about 450° F. (232° C.) is then added to the conversion product stream to form a combined stream, the amount of the incompatibility stream being from about twice the first volume to about four times the first volume. The incompatibility stream includes at least a light boiling point fraction. The combined stream is washed with water to remove precipitated solids from the combined stream. In some embodiments, the precipitated solids can be removed as a settled phase of solids, and/or as solids from a phase boundary layer between a hydrocarbon phase and an aqueous phase after phase separation. The washed combined stream is then separated into a self-compatible product stream and a light ends portion. The light ends portion is stored in a vessel, wherein the light ends stream comprises the stored light ends portion.

In a second embodiment, a process for producing a stable hydrocarbon product stream is provided. The process includes performing a conversion process on a heavy oils feedstream with an API gravity of less than about 19 to produce at least a liquid conversion product stream. The liquid conversion product stream is washed with water to remove precipitated solids from the liquid conversion product stream, the washed liquid conversion product stream having an API gravity of at least about 20. The washed liquid conversion product stream is then fractionated to form a self-compatible product stream and a light ends portion, the light ends portion comprising at least a lowest boiling 1% of a volume of the washed liquid conversion product stream, wherein the self-compatible product stream has a solubility blending number that is at least about 10 greater than an incompatibility number of the self-compatible product stream.

In a third embodiment, a process according to the first or second embodiment is provided, wherein the conversion process comprises a desulfurization process using an alkali metal salt reagent.

In a fourth embodiment, a process for producing a stable hydrocarbon product stream is provided. The process includes contacting a sulfur-containing heavy oils feedstream with an API gravity of less than about 19 with a first alkali metal salt reagent stream. This can produce a condensable low boiling portion having a boiling point of about 450° F. (232° C.) or less and a desulfurized reaction stream comprised of desulfurized hydrocarbon compounds, spent alkali metal salt compounds, and hydrogen, where the desulfurized reaction stream has a solubility blending number. The desulfurized reaction stream is combined with an incompatibility stream to produce a combined stream having a solubility blending number that is at least about 20 less than the desulfurized reaction stream solubility blending number. The incompatibility stream includes at least one of the condensable portion and a light ends stream. The combined stream is then exposed to a water wash. The washed combined stream is separated into an aqueous spent alkali metal salt stream and a desulfurized hydrocarbon product stream in a hydrocarbon product separator. The desulfurized hydrocarbon product stream is then fractionated to form a self-compatible product stream and a light ends portion. The light ends portion is stored in a vessel, wherein the light ends stream comprises the stored light ends portion.

In a fifth embodiment, a process according to the fourth embodiment is provided, wherein the reaction conditions in the first reaction zone are a pressure of from about 50 to about 3000 psi (345 to 20,684 kPa), and a temperature from about 600° F. to about 900° F. (316° C. to 482° C.).

In a sixth embodiment, a process according to the fourth or fifth embodiments is provided, further comprising contacting the heavy oil feedstream with the alkali metal salt reagent in the presence of hydrogen, the hydrogen partial pressure being from about 100 to about 2500 psi (689 to 17,237 kPa).

In a seventh embodiment, a process according to the third through sixth embodiments is provided, wherein the alkali metal salt reagent stream comprises potassium sulfide, potassium hydroxide, potassium hydrogen sulfide (KHS), potassium sodium sulfide (KNaS), or a mixture thereof.

In a eighth embodiment, a process according to the third through sixth embodiments is provided, wherein the heavy oils feedstream has a sulfur content of at least about 2 wt %, more preferably at least about 3 wt %. In an even more preferred embodiment, the self-compatible product stream produced by the present invention has a sulfur content of less than 1 wt %.

In a ninth embodiment, a process according to the first or third through eighth embodiments is provided, wherein the solubility blending number ($S_{BN}$) of the self-compatible product stream is about 10 greater, and even more preferably about 20 greater than the solubility blending number ($S_{BN}$) of the conversion product stream.

In a tenth embodiment, a process according to the third through sixth embodiments is provided, wherein the solubility blending number ($S_{BN}$) of the self-compatible product stream is about 10 greater, and even more preferably about 20 greater than the insolubility number ($I_N$) of the self-compatible product stream.

In a eleventh embodiment, a process according to the first or third through tenth embodiments is provided, wherein an API gravity of the combined stream is at least about 2 greater than an API gravity of the self-compatible product stream.

In a twelfth embodiment, a process according to the second embodiment is provided, wherein the solubility blending number ($S_{BN}$) of the self-compatible product stream is at least about 20 greater than the incompatibility number ($I_N$).

In a thirteenth embodiment, a process according to the second embodiment is provided, wherein the conversion process produces a low boiling stream having a boiling point of about 450° F. (232° C.) or less, and wherein the process further comprises adding at least a portion of the low boiling stream to liquid conversion product stream prior to washing the liquid conversion product stream.

Although the present invention has been described in terms of specific embodiments, it is not so limited. Suitable alterations and modifications for operation under specific conditions will be apparent to those skilled in the art. It is therefore intended that the following claims be interpreted as covering all such alterations and modifications as fall within the true spirit and scope of the invention.

What is claimed is:

1. A process for producing a stable self-compatible hydrocarbon product stream, comprising:

performing a conversion process on a heavy oils feedstream with an API gravity of less than about 19 to produce a conversion product stream comprised of a conversion product stream having an API gravity of at least about 20;

adding an incompatibility stream having a T5 boiling point of at least 80° F. and a T95 boiling point less than about 450° F. (232° C.) to the conversion product stream to form a mixed conversion stream;

washing the mixed conversion stream with water to remove precipitated solids from the mixed conversion stream thereby forming a washed product stream;

separating the washed product stream into a self-compatible product stream and a light ends fraction; and storing at least a portion of the light ends fraction in a vessel;

wherein the incompatibility stream is comprised of at least a portion of the light ends fraction and the light ends fraction comprises at least a lowest boiling 2% by volume of the washed product stream and having a T5 boiling point of at least 80° F. and a T95 boiling point less than about 450° F. (232° C.).

2. The method of claim 1, wherein the API gravity of the self-compatible product stream is at least about 2 greater than the API gravity of the conversion product stream.

3. The method of claim 1, wherein the conversion process comprises a desulfurization process using an alkali metal salt reagent.

4. The process of claim 3, wherein the alkali metal salt reagent comprises potassium hydroxide, potassium sulfide, potassium hydrogen sulfide, or a mixture thereof.

5. The process of claim 3, wherein an aqueous spent alkali metal stream is also separated from the mixed conversion stream in the water washing step.

6. The process of claim 1, wherein the conversion process also produces an overhead stream comprised of hydrogen and hydrogen sulfide.

7. The process of claim 1, wherein the amount of the incompatibility stream added to the conversion product stream is sufficient to lower the solubility blending number ($S_{BN}$) of the combined incompatibility stream and conversion product stream by at least 10.

8. The process of claim 7, wherein the solubility blending number ($S_{BN}$) of the self-compatible product stream is at least about 20 greater than the solubility blending number ($S_{BN}$) of the conversion product stream.

9. The process of claim 8, wherein the solubility blending number ($S_{BN}$) of the self-compatible product stream is about 20 greater than the insolubility number ($I_N$) of the self-compatible product stream.

10. The process of claim 1, wherein the amount of the incompatibility stream (by mass flow rate) added to the conversion product stream is at least about twice the amount of the light ends fraction (by mass flow rate) separated from the washed product stream.

11. The process of claim 1, wherein the conversion process comprises a visbreaking process, a coking process, an alkali metal desulfurization process, a catalytic desulfurization process, a thermal cracking process, or a combination thereof.

12. The process of claim 1, wherein the conversion process further comprises introducing hydrogen into the conversion process.

13. The process of claim 1, wherein the mixed conversion stream is contacted with the water in a water wash vessel, and an aqueous phase stream comprised of water and spent alkali metal salts is removed from the bottom portion of the water wash vessel.

14. The process of claim 13, wherein aqueous phase stream is further comprised of asphaltenes, coke, and metals.

15. The process of claim 1, wherein the heavy oils feedstream has a sulfur content of at least 3 wt % and the self-compatible product stream has a sulfur content of less than 1 wt %.

16. The process of claim 1, wherein the reaction conditions of the conversion process comprise a pressure of from about 50 to about 3000 psi (345 to 20,684 kPa), and a temperature from about 600° F. to about 900° F. (316° C. to 482° C.).

17. The process of claim 1, further comprising contacting the heavy oil feedstream with the alkali metal salt reagent in the presence of hydrogen, the hydrogen partial pressure being from about 100 to about 2500 psi (689 to 17,237 kPa).

18. A process for producing a stable self-compatible hydrocarbon product stream, comprising:

performing a conversion process on a heavy oils feedstream with an API gravity of less than about 19 to produce at least a liquid conversion product stream with an API gravity of at least about 20;

washing the liquid conversion product stream with water to remove at least a portion of the precipitated solids from the liquid conversion product stream to form a washed liquid conversion product stream; and fractionating the washed liquid conversion product stream to form a self-compatible product stream and a light ends fraction, the light ends fraction comprising at least a lowest boiling 2% by volume of the washed liquid conversion product stream and having a T5 boiling point of at least 80° F. and a T95 boiling point less than about 450° F. (232° C.), wherein the self-compatible product stream has a solubility blending number ($S_{BN}$) that is at least about 10 greater than the insolubility number ($I_N$) of the self-compatible product stream.

19. The process of claim 18, wherein the conversion process further comprises introducing hydrogen into the conversion process.

20. The method of claim 19, wherein the conversion process comprises a desulfurization process using an alkali metal salt reagent.

21. The process of claim 20, wherein the alkali metal salt reagent comprises potassium hydroxide, potassium sulfide, potassium hydrogen sulfide, or a mixture thereof.

22. The process of claim 20, wherein the reaction conditions of the conversion process comprise a pressure of from about 50 to about 3000 psi (345 to 20,684 kPa), and a temperature from about 600° F. to about 900° F. (316° C. to 482° C.).

23. The process of claim 22, wherein the hydrogen partial pressure in the conversion process is from about 100 to about 2500 psi (689 to 17,237 kPa).

* * * * *